US007686177B1

(12) United States Patent
Jackson

(10) Patent No.: US 7,686,177 B1
(45) Date of Patent: Mar. 30, 2010

(54) UNCOUPLING LEVER ASSEMBLY

(75) Inventor: John M. Jackson, Coloma, MI (US)

(73) Assignee: Jackson International, Inc., Constantine, MI (US)

( * ) Notice: Subject to any disclaimer, the term of this patent is extended or adjusted under 35 U.S.C. 154(b) by 0 days.

(21) Appl. No.: 12/036,443

(22) Filed: Feb. 25, 2008

(51) Int. Cl.
*B61G 3/08* (2006.01)

(52) U.S. Cl. ..... 213/159; 213/166; 213/163

(58) Field of Classification Search ..... 213/159
See application file for complete search history.

(56) References Cited

U.S. PATENT DOCUMENTS 4,010,854 A 3/1977 Manyek 6,739,464 B1 5/2004 Manyek

*Primary Examiner*—S. Joseph Morano
*Assistant Examiner*—Zachary Kuhfuss
(74) *Attorney, Agent, or Firm*—Botkin & Hall, LLP

(57) ABSTRACT

An improved lever assembly for uncoupling railroad cars having a coupler that includes a lock lifter. The lever assembly has a handle on one end that is pivotally connected to the railcar and a hook located at the other end of the lever assembly that is connected to the lock lifter. The assembly has levers that slide relative to each other. The levers are held adjacent to each other by enclosures through which the levers slide. The enclosures contain U-shaped glides held stationary relative to the enclosures. Typically made of plastic, the glides provide low friction sliding contact with levers sliding through them. The glides are longitudinally shorter than their containing enclosures providing protection from ultraviolet light.

8 Claims, 6 Drawing Sheets

UNCOUPLING LEVER ASSEMBLY

BACKGROUND OF THE INVENTION

Uncoupling lever assemblies connected to railcars must be able to rotate the lock lifter of a coupler and also be able to change their length to accommodate movement of the coupler relative to the railcar during travel. Uncoupling levers are typically connected to the railcar with a pivotal connection on the handle, and the opposite end is connected to the lock lifter on the coupler. Rotating the handle causes the lever assembly to rotate and also rotates the lock lifter. Rotating the lock lifter causes the coupler to release so that adjacent cars may be uncoupled. The coupler will move laterally relative to the railcar when the railcar negotiates turns. Couplers may also extend or retract upon impact with other railcars. As the coupler moves relative to the railcar, the distance between the coupler and the mounting location of the handle changes, therefore, the length of the lever assembly must change.

It is important that the levers of the lever assembly remain freely movable relative to each other without binding. When the coupler moves, it does so with great force. Any binding in the lever assembly prevents it from changing its length, which could result in damage to the railcar, damage to the coupler, and/or damage to the lever assembly. Several attempts to produce levers that change their length without binding have been made. Plastic glides have been used that go into enclosures that levers slide through so that individual levers may slide relative to each other without metal-to-metal contact that will likely cause binding. Over time, plastic glides can be degraded by ultraviolet (UV) light. If glides become brittle due to UV light exposure, they may become cracked, fall out of the enclosures, and allow metal-to-metal contact between the levers and enclosures. Glides in the prior art generally depend on external protrusions to retain them in their enclosures. Failure of the external protrusions from UV light degradation will cause the glides to dislodge from their enclosures and allow metal-to-metal contact between the levers and enclosures.

SUMMARY OF THE INVENTION

This invention provides an improved uncoupling lever assembly adapted for use on railroad cars having a coupler that includes a lock lifter. The lever assembly has a handle that is located at a handle end of the lever assembly. The handle is pivotally connected to the railcar. A hook is located at a hook end of the lever assembly and is adapted to connect with the lock lifter. A first lever is connected to the handle, and a second lever is connected to the hook. A middle lever has enclosures located on opposite sides. The enclosures have an inside wall that is attached to the middle lever. The inside wall has a circular hole extending through it. The enclosures also have an outside wall that faces outward relative to the middle lever, a top wall and a bottom wall. The top, bottom, inside, and outside walls have longitudinal ends that define the ends of the enclosures.

The lever assembly has U-shaped glides that have a pair of legs and a bridge that join the legs. One of the legs has a boss that extends outwardly from an exterior surface. The glides are longitudinally shorter than the enclosures and are contained with a corresponding enclosure so that the boss protrudes into a hole extending through a wall of the enclosure. The boss in the hole prevents lateral movement of the glide relative to its containing enclosure. The first lever is slidably received within a corresponding glide and the second lever is slidably received within a corresponding glide on an opposite side of the middle lever. The first and second levers are slidable relative to the middle lever.

In another aspect of the invention, the middle lever contains at least two enclosures attached to each side of the middle lever, and a glide within its corresponding enclosure is positioned so that the bridge contacts the top wall of the corresponding enclosure containing the glide to define a first position. Another glide in its corresponding enclosure on the same side of the middle lever is positioned so that the bridge contacts the bottom wall to define a second position. The glides in adjacent enclosures on the same side of the middle lever alternate between first and second positions.

In another aspect of the invention, the hole is located in the inside wall, and the hole receives the boss.

In yet another aspect of the invention, the working end of the hook is substantially aligned with the second lever.

DETAILED DESCRIPTION OF INVENTION

The lever assembly 10 of this invention is adapted for use on a railcar 12 that has a coupler 14 that includes a lock lifter. The lock lifter is a part of the coupler 14 used to release the coupler so that adjacent couplers on adjacent railcars may be released from each other to separate the railcars. The lock lifter is on the underside of the coupler 14 and is hidden in FIG. 1, which shows how the lever assembly 10 is attached to the railcar 12 and coupler 14.

Figure 1:
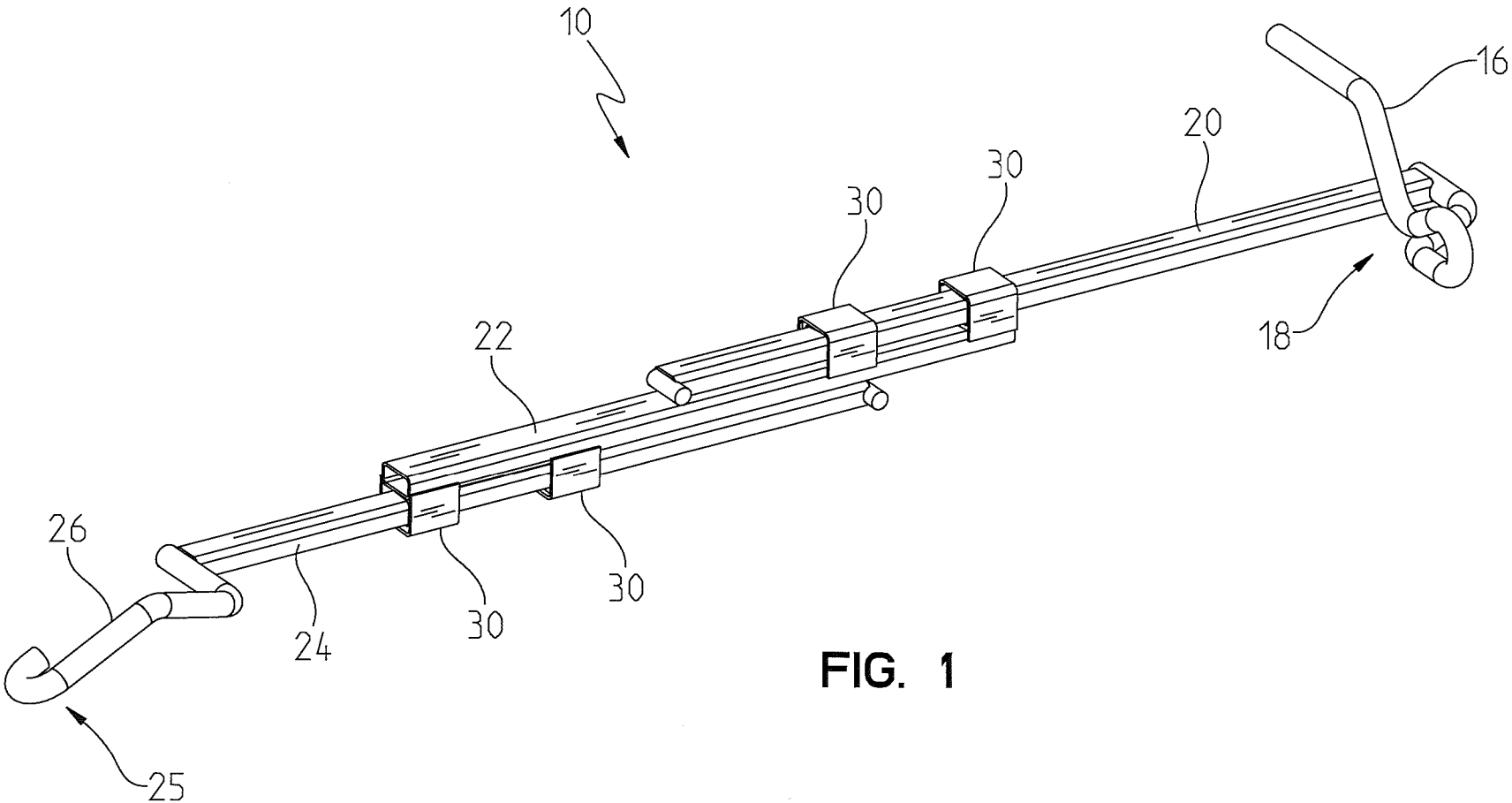
FIG. 1 is a perspective view of the first embodiment of the lever assembly of this invention.
Figure 2:
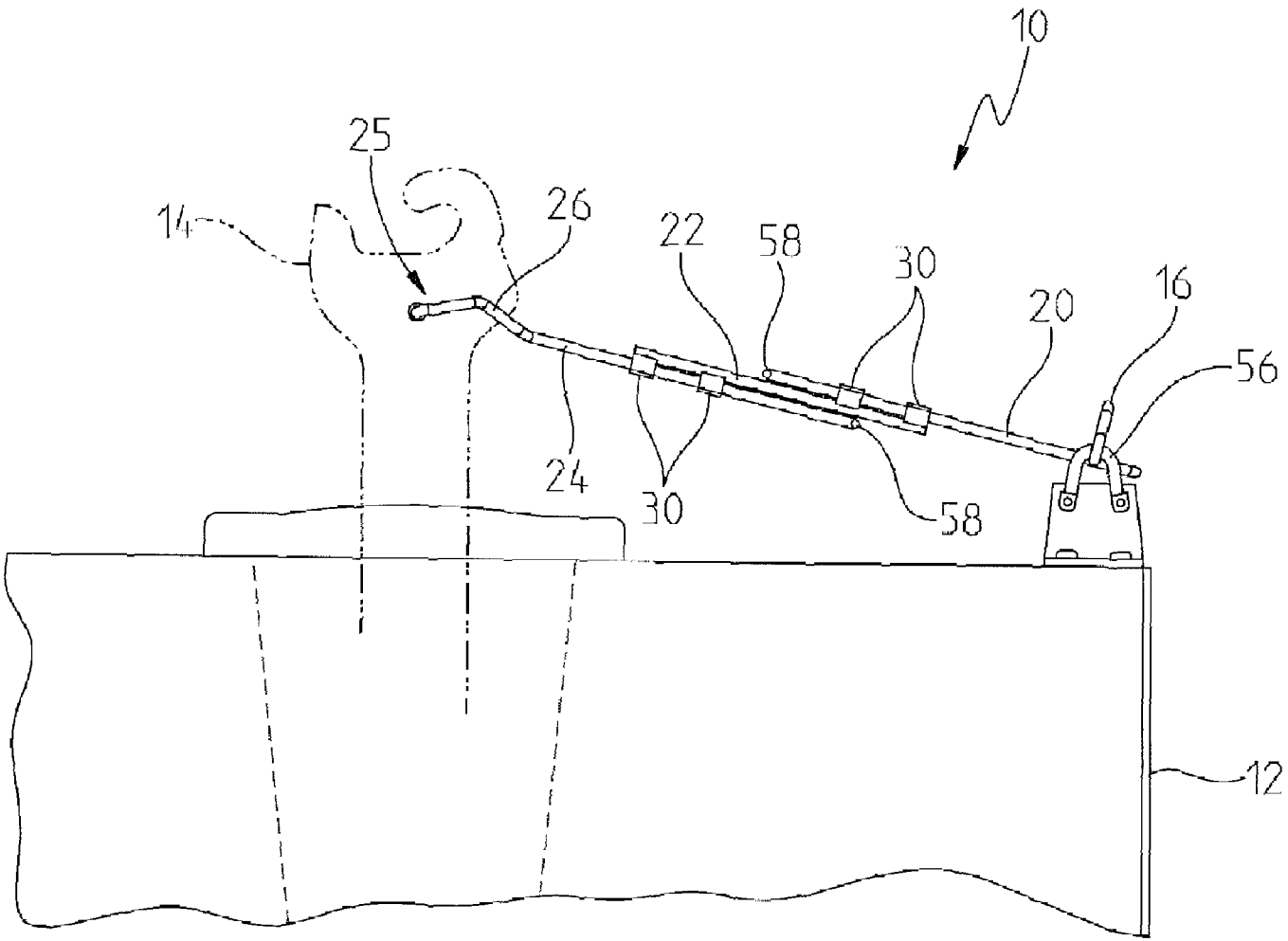
FIG. 2 is a top view of the lever assembly shown in FIG. 1 as used on a railcar.
Figure 3:
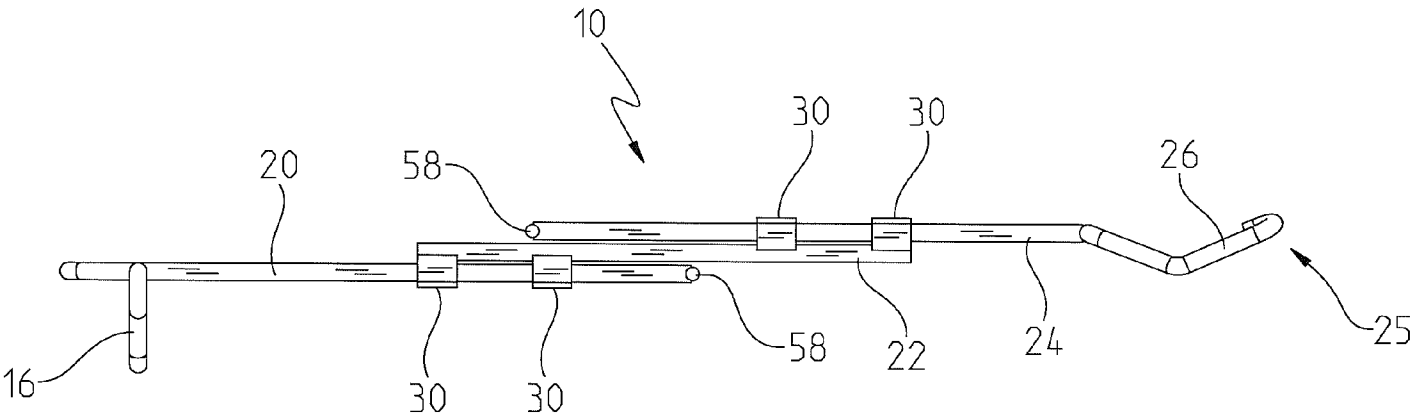
FIG. 3 is a top view of the lever assembly shown in FIG. 1.
Figure 4:
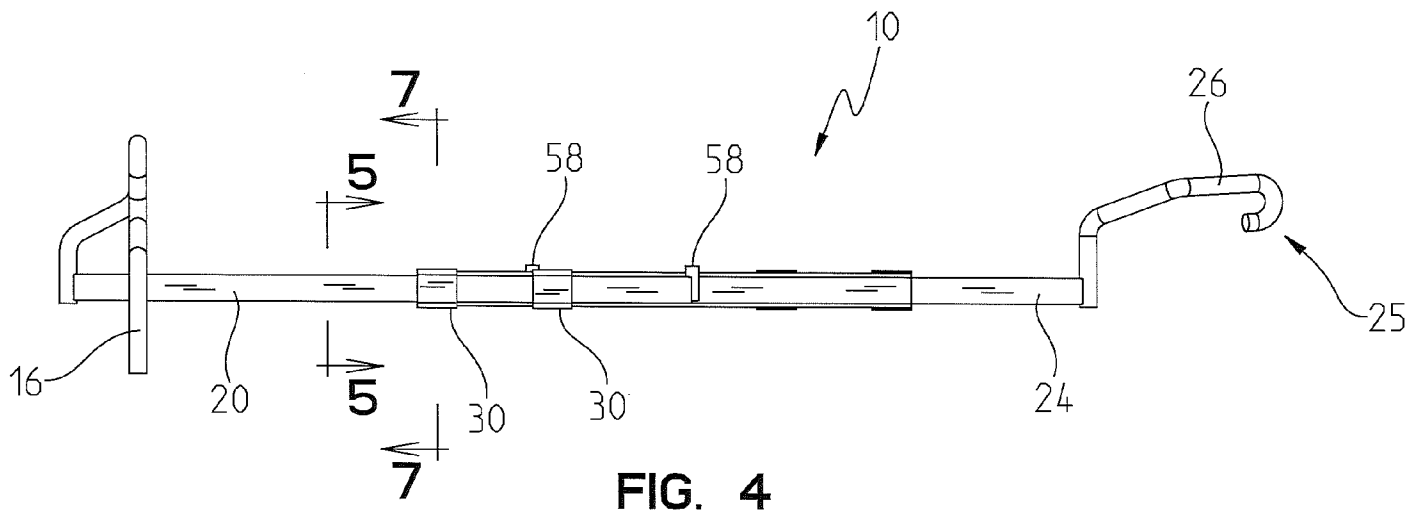
FIG. 4 is a side view of the lever assembly shown in FIG. 1.

The lever assembly 10 has a handle 16 that is attached to a handle end 18 of a first lever 20. A middle lever 22 is positioned next to the first lever 20. A second lever 24 is positioned next to the middle lever on the opposite side of the first lever 20. The levers 20, 22, 24 are made from tubular steel as shown in FIG. 1, but could also be made of solid bar stock as well. The second lever 24 has a hook 26 attached at an end of the lever 24 facing away from the handle end 18 of the first lever 20. The hook 26 has a working end 25 that is adapted to connect with the lock lifter.

Figure 5:
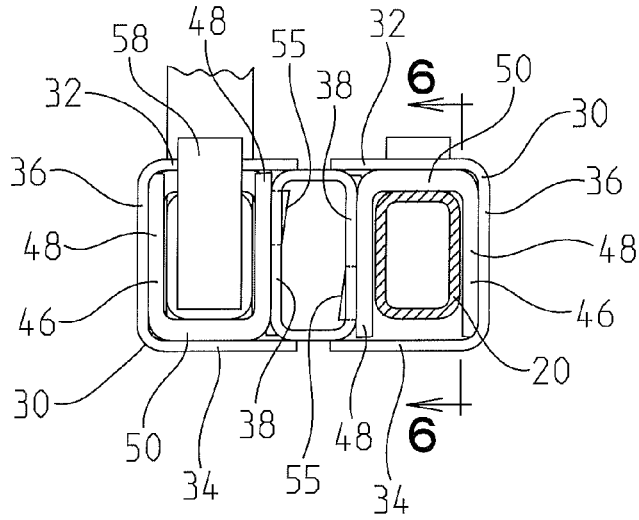
FIG. 5 is a is a sectional view taken about line 5-5 in FIG. 4.
Figure 6:
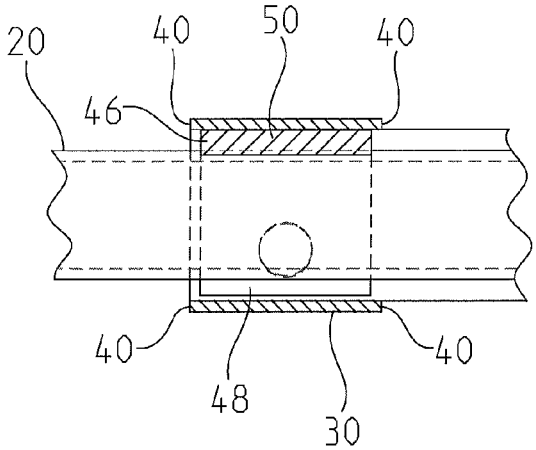
FIG. 6 is a sectional view taken about line 6-6 in FIG. 5.
Figure 7:
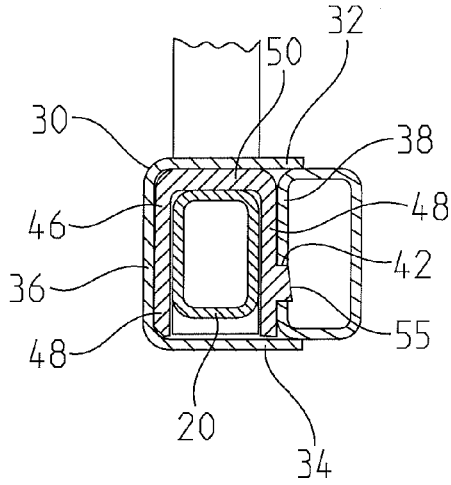
FIG. 7 is a sectional view taken about the line 7-7 in FIG. 4.
Figure 8:
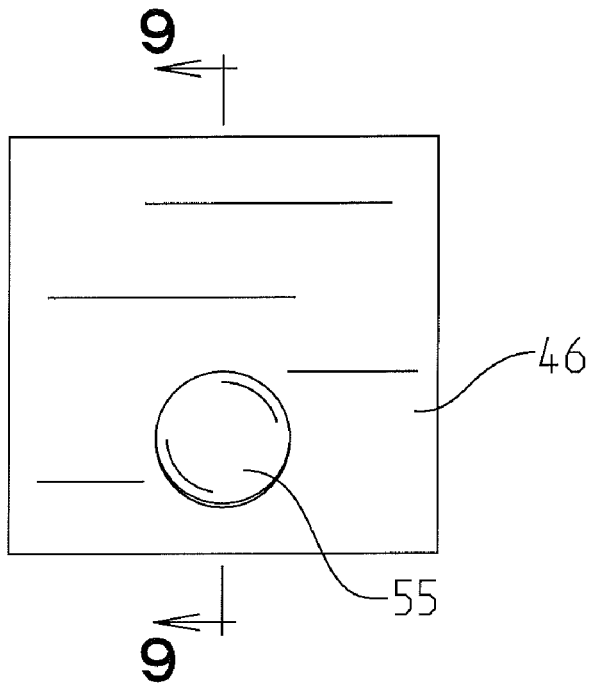
FIG. 8 is a side view of a glide showing the cylindrical boss.

Enclosures 30 are attached to opposite sides of the middle lever 22. Detailed section views of the enclosures 30 are shown in FIGS. 5, 6, 7. Each enclosure has a top wall 32, bottom wall 34, an outside wall 36, and an inside wall 38. The walls 32, 34, 36 of the enclosure have longitudinal ends 40 that define the ends of the enclosures 30. The enclosures 30 are attached by welding the top and bottom walls 32, 34 to the middle lever 22. The inside wall 38 is defined by a portion of the middle lever 22 enclosed by the top, bottom, and outside walls 32, 34, 36. A hole 42 is formed so as to extend through the inside wall of the enclosure 30.

Figure 9:
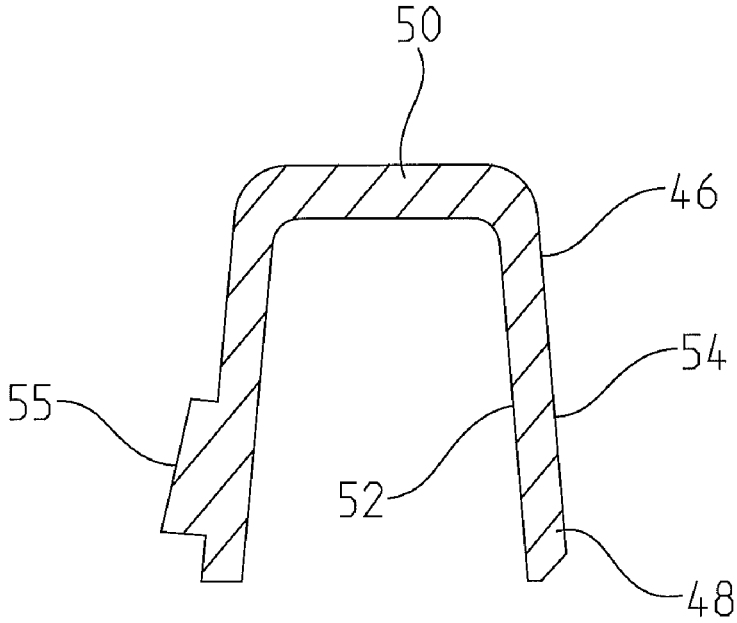
FIG. 9 is a sectional view taken about line 9-9 in FIG. 8.

Each enclosure 30 retains a glide 46. The glide 46 is U-shaped having legs 48 that are joined by a bridge 50. The glide 46 has an interior surface 52 and an exterior surface 54. One of the legs 48 has a boss 55 that protrudes from the exterior surface 54 of the glide 46. In one embodiment, the boss 55 is cylindrical and engages the hole 42 so that the glide 46 does not slide longitudinally relative to the enclosure 30. When the glide 46 is not installed in the enclosure 30, the legs 48 are biased outward as shown in FIG. 9. This bias ensures that the cylindrical boss 55 will engage in the hole 42. The glides 46 are typically made of plastic which provides low friction sliding contact with the levers 20, 24 that slide through them. Each end of the middle lever 22 has at least two enclosures 30 that are adjacent to each other. A glide 46 in one of the enclosures is oriented so that the bridge 50 is against the top wall 32 of its corresponding enclosure. This configuration defines a first position of the glide 46. The glide 46 in an adjacent enclosure 30 at the same end of the middle lever 22 is oriented so that the bridge 50 is against the bottom wall 34 of its corresponding enclosure 30. This configuration defines a second position of the glide 46. The glides 46 in adjacent enclosures 30 alternate between the first and second positions. This ensures no metal-to-metal contact occurs because all sides of the levers 20, 24 contact the plastic of the glides 46 and do not rub against the metal of the enclosure 30.

Ultraviolet light will degrade many plastics over time which will tend to make the glides 46 brittle. Each glide 46 is shorter in its longitudinal direction than the corresponding enclosure 30 that retains it, and no part of the glide 46 extends beyond the longitudinal ends of the enclosure. This prevents ultraviolet light from striking the glides 46. The boss 55 engages a hole 42 in the inside wall 38 of the enclosure 30 so that the boss 55 is also shielded from ultraviolet light.

The lever assembly 10 is pivotally attached to the railcar 12 at the handle end 18 and connected at working end of the hook 25 to the lock lifter on the coupler. The handle 16 is hung on a U-shaped hanger 56 that is attached to the railcar 12. The coupler 14 will move laterally relative to the railcar 12 when the railcar 12 negotiates turns. The coupler 14 may also extend or retract upon impact with other railcars, which will cause the distance between the lock lifter and the U-shaped hanger 56 to change. The levers are slidably received in the glides 46, so that the first and second levers 20, 24 slide relative to the middle lever 22, which enables the overall length of the lever assembly 10 to change to accommodate movement of the coupler 14 relative to the railcar during travel of the train. The maximum length of the lever assembly is reached when both the first and second levers 20, 24 are moved until stops 58 hit the ends 40 of the enclosures.

Since the glides 46 are contained within the ends, lateral forces on the levers 20, 24 are kept to a minimum so that the first and second levers 20, 24 remain slidable relative to the middle lever 22. To reduce lateral forces on the levers 20, 24, the working end 25 of the hook 26 is placed in line with the centerline of the second lever 24. This prevents a moment from being imparted on the levers 20, 24 if the working end 25 of the hook 26 were to be laterally offset from the centerline of the second lever 24.

Figure 10:
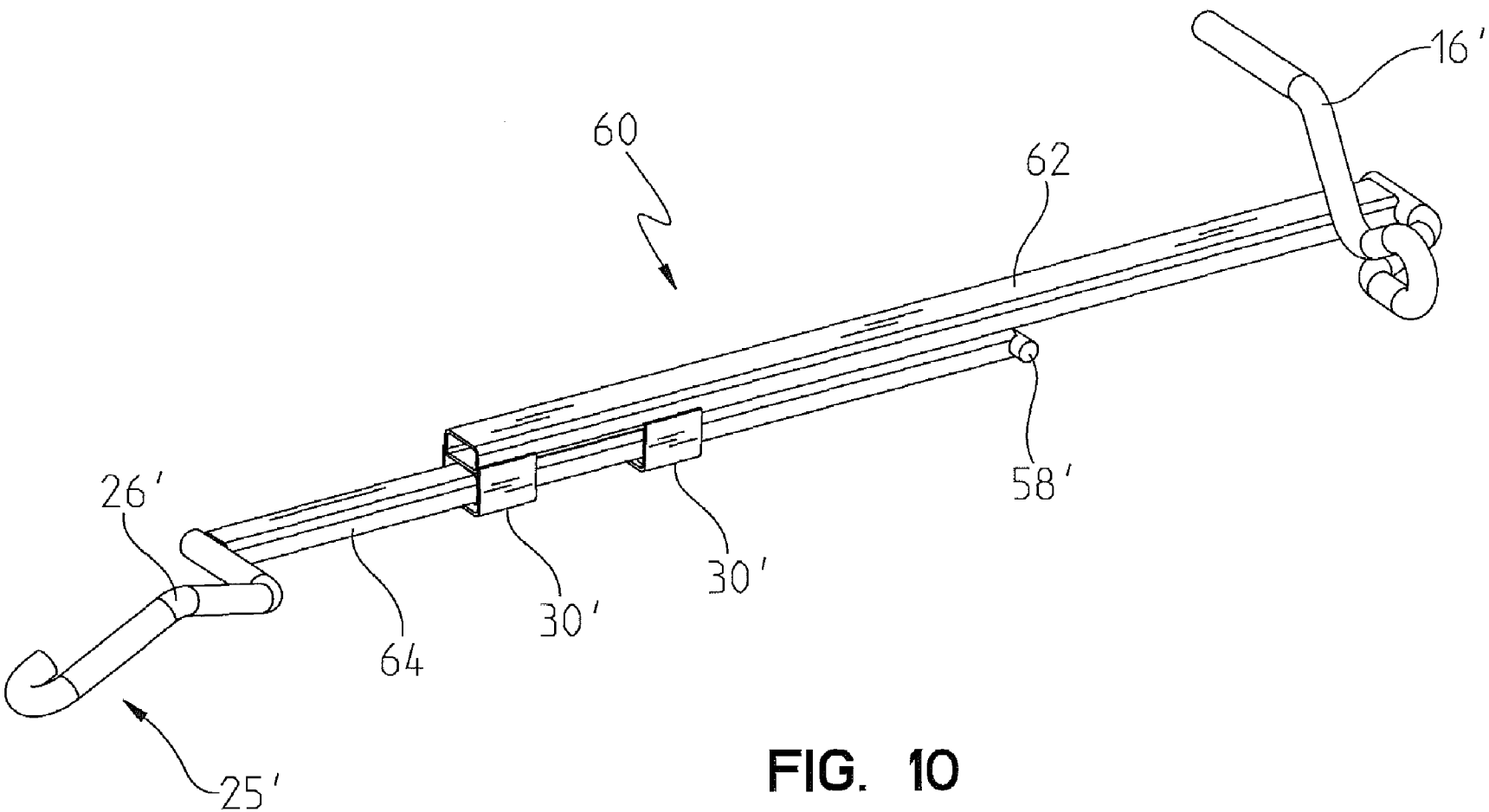
FIG. 10 is a perspective view of the second embodiment of the lever assembly of this invention.

A second embodiment of the lever assembly 60 is shown in FIG. 10. This embodiment functions in much the same way as the first embodiment shown in FIG. 1, and is mounted to the railcar 12 in the same way. In this embodiment there are only two levers, a first lever 62 and a second lever 64. The first lever 62 has a handle 16' and enclosures 30' attached thereon. Glides 46 are retained within the enclosures 30'. The second lever 64 has a stop 58' that prevents the second lever 64 from moving beyond the enclosures 30'. The second lever has a hook 26' with a working end 25' that is welded to the end of second lever 64 opposite the stop 58'. The glides 46 allow relative movement between the levers 62, 64 so that the length of the lever assembly 60 may change as the coupler 14 moves.

The invention is not limited to the details given above, but may be modified within the scope of the following claims.

What is claimed is:

1. An uncoupling lever assembly particularly adapted for use on a railroad car having a coupler including a lock lifter, said coupler mounted to an end of said railcar, said lever assembly comprising:

a handle located at a handle end of said lever assembly and pivotally connected to said railcar;

a first lever connected to said handle;

a second lever;

a hook attached to said second lever said hook having a working end that is adapted to connect with said lock lifter;

a middle lever;

enclosures attached on opposite sides of said middle lever, said enclosures having an inside wall facing said middle lever, an outside wall facing outward relative to said middle lever, a top wall and a bottom wall, said top, bottom, and outside walls having longitudinal ends defining ends of said enclosures, at least one of said walls having a hole; and U-shaped glides, each of said glides having a pair of legs and a bridge joining said legs, said glides having an interior and exterior surface, a boss extending from only one of said legs, each glide being longitudinally shorter than said enclosures and being contained within a corresponding enclosure so that said hole receives said boss to prevent movement of said glide relative to its corresponding enclosure, and so that no part of said glide extends beyond said longitudinal ends of its corresponding enclosure, said first lever being slidably received within a corresponding glide and said second lever slidably received within a corresponding glide on the other side of said middle lever, wherein said first and second levers are slidable relative to said middle lever.

2. A lever assembly as claimed in claim 1, wherein said middle lever includes at least two adjacent enclosures attached to each end of said middle lever, a glide within its corresponding enclosure positioned so that said bridge contacts said top wall of said corresponding enclosure containing said glide to define a first position and another glide in its corresponding enclosure on the same end of said middle lever is positioned so that said bridge contacts said bottom wall to define a second position, each of said glides in adjacent enclosures alternating between said first and second positions.

3. A lever assembly as claimed in claim 1, wherein said hole is located in said inside wall.

4. A lever assembly as claimed in claim 1, wherein said working end of said hook is substantially aligned with said second lever.

5. An uncoupling lever assembly particularly adapted for use on a railroad car having a coupler including a lock lifter, said coupler mounted to an end of said railcar, said lever assembly comprising:

a handle located at a handle end of said lever assembly and pivotally connected to said railcar;

a first lever connected to said handle;

a second lever;

a hook attached to said second lever, said hook having a working end that is adapted to connect with said lock lifter;

enclosures attached to a corresponding lever, said enclosures having an inside wall facing said corresponding lever, an outside wall facing outward relative to said corresponding lever, a top wall and a bottom wall, said top, bottom, and outside walls having longitudinal ends defining ends of said enclosures, at least one of said walls having a hole; and U-shaped glides, each of said glides having a pair of legs and a bridge joining said legs, said glides having an interior and exterior surface, a boss extending from only one of said legs, each glide being longitudinally shorter than said enclosures and being contained within a corresponding enclosure so that said hole receives said boss to prevent movement of said glide relative to its corresponding enclosure, and so that no part of said glide extends beyond said longitudinal ends of said corresponding enclosure, one of said levers slidably received within a corresponding glide, wherein said first and second levers are slidable relative each other.

6. A lever assembly as claimed in claim 5, wherein said hole is located in said inside wall.

7. A lever assembly as claimed in claim 5, wherein said working end of said hook is substantially aligned with said second lever.

8. A lever assembly as claimed in claim 5, wherein one of said levers includes at least two adjacent enclosures attached to an end of said lever, a glide contained in a corresponding enclosure positioned so that said bridge contacts said top wall of said corresponding enclosure to define a first position and another glide in its corresponding enclosure on the same end of said lever positioned so that said bridge contacts said bottom wall to define a second position, each of said glides in adjacent enclosures alternating between said first and second positions.

* * * * *